US008607888B2

(12) United States Patent
Nusbaum

(10) Patent No.: US 8,607,888 B2
(45) Date of Patent: Dec. 17, 2013

(54) SELF-CONTAINED AUTOMATIC FIRE EXTINGUISHER

(76) Inventor: Michael Jay Nusbaum, Far Hills, NJ (US)

( * ) Notice: Subject to any disclaimer, the term of this patent is extended or adjusted under 35 U.S.C. 154(b) by 919 days.

(21) Appl. No.: 12/070,174

(22) Filed: Feb. 14, 2008

(65) Prior Publication Data

US 2008/0196906 A1 Aug. 21, 2008

Related U.S. Application Data

(60) Provisional application No. 60/901,948, filed on Feb. 16, 2007.

(51) Int. Cl.
*A62C 31/02* (2006.01)

(52) U.S. Cl.
USPC ..... 169/74; 239/208; 239/283

(58) Field of Classification Search
USPC ..... 169/7–891; 239/208, 209, 282, 283
See application file for complete search history.

(56) References Cited

U.S. PATENT DOCUMENTS

| | | | | |
|---|---|---|---|---|
| 883,149 | A * | 3/1908 | Shafer | 169/57 |
| 1,931,239 | A | 10/1933 | Laengel | |
| 2,115,371 | A | 4/1938 | Mossberg | |
| 2,166,277 | A | 7/1939 | Adams | |
| 2,759,546 | A | 8/1956 | Zabriskie | |
| 2,857,971 | A | 10/1958 | Ferris | |
| 3,356,148 | A | 12/1967 | Jamison | |
| 3,463,235 | A * | 8/1969 | Flajole | 169/9 |
| 3,536,139 | A | 10/1970 | Berti | |
| 3,587,747 | A | 6/1971 | Romero | |
| 3,592,269 | A | 7/1971 | Stults | |
| 3,638,733 | A | 2/1972 | De Rouville et al. | |

(Continued)

FOREIGN PATENT DOCUMENTS

| | | |
|---|---|---|
| JP | 61-45198 | 3/1986 |
| JP | 08-141102 A | 6/1996 |

(Continued)

OTHER PUBLICATIONS

Written Opinion PCT, Jun. 25, 2008, Michael J. Nusbaum.

(Continued)

*Primary Examiner* — Christopher Kim
(74) *Attorney, Agent, or Firm* — Gearhart Law LLC

(57) ABSTRACT

A self-contained automatic fire extinguishing device that is located within a wall or ceiling and housed within the space between two studs or joists. This unit includes a tank or series of tanks attached via flexible pressurized joints, and held in place by an expanding bracket. This fire extinguisher maintains a constantly high pressure inside a shell of the fire extinguisher through out a shelf-life of the fire extinguisher and which can indicate the charge status of the tank via a visible indicator. A sensor is attached to the unit, which reacts to prolonged exposure to direct heat and which can extend a nozzle beyond the wall or ceiling into the living space when actuated. The self-contained automatic fire extinguishing device is hidden behind a decorative face plate which permits the passage of the sensing device and a tank fill status indicator and which actuates out of the path of the nozzle upon activation. Prior to activation, an audible warning is sounded from the device to indicate the presence of a fire and an impending activation. Once activated, the fire extinguisher contents are dispersed into the space thus significantly retarding or completely extinguishing the fire.

8 Claims, 8 Drawing Sheets

(56) References Cited

U.S. PATENT DOCUMENTS 3,750,754 A 8/1973 Stults
3,820,607 A 6/1974 Miley
3,917,117 A 11/1975 Plotsky
4,006,780 A 2/1977 Zehr
RE29,155 E 3/1977 Mears et al.
4,047,571 A 9/1977 Chaintrier et al.
4,088,192 A 5/1978 Lamond
4,256,181 A 3/1981 Searcy
4,299,289 A 11/1981 Kato
4,691,783 A 9/1987 Stern et al.
4,730,182 A 3/1988 Tsubouchi
4,773,485 A 9/1988 Silverman
4,805,701 A 2/1989 Mountford
4,821,963 A 4/1989 Arnout et al.
4,830,113 A 5/1989 Walden et al.
4,836,409 A 6/1989 Lane
5,016,715 A 5/1991 Alasio
5,040,610 A 8/1991 Blanchong
5,059,127 A 10/1991 Lewis et al.
5,085,278 A 2/1992 Keltner
5,096,124 A 3/1992 Young
5,117,353 A 5/1992 Stipanovich et al.
5,123,490 A 6/1992 Jenne
5,127,479 A 7/1992 Stehling et al.
5,163,203 A 11/1992 Tanasescu et al.
5,164,897 A 11/1992 Clark et al.
5,170,362 A 12/1992 Greenberg et al.
5,197,004 A 3/1993 Sobotka et al.
5,315,292 A 5/1994 Prior
5,326,270 A 7/1994 Ostby et al.
5,416,694 A 5/1995 Parrish et al.
5,441,113 A 8/1995 Pierce
5,461,699 A 10/1995 Arbabi et al.
5,490,097 A 2/1996 Swenson et al.
5,505,266 A 4/1996 Fujiki
5,551,517 A 9/1996 Arsenault et al.
5,551,880 A 9/1996 Bonnstetter et al.
5,565,316 A 10/1996 Kershaw et al.
5,592,375 A 1/1997 Salmon et al.
5,618,182 A 4/1997 Thomas
5,671,409 A 9/1997 Fatseas et al.
5,722,418 A 3/1998 Bro
5,727,128 A 3/1998 Morrison
5,771,977 A 6/1998 Schmidt
5,774,883 A 6/1998 Andersen et al.
5,788,504 A 8/1998 Rice et al.
5,827,070 A 10/1998 Kershaw et al.
5,832,497 A 11/1998 Taylor
5,885,087 A 3/1999 Thomas
5,890,544 A * 4/1999 Love et al. ..... 169/51
5,921,322 A * 7/1999 Bonfield et al. ..... 169/37
5,978,768 A 11/1999 McGovern et al.
5,980,096 A 11/1999 Thalhammer-Reyero
5,992,531 A 11/1999 Mikulec
6,003,609 A 12/1999 Walls
6,035,295 A 3/2000 Klein
6,056,556 A 5/2000 Braun et al.
6,070,143 A 5/2000 Barney et al.
6,086,382 A 7/2000 Thomas
6,115,646 A 9/2000 Fiszman et al.
6,126,448 A 10/2000 Ho et al.
6,131,667 A 10/2000 Jesadanont et al.
6,144,838 A 11/2000 Sheehan
6,161,624 A 12/2000 Bennett
6,189,029 B1 2/2001 Fuerst
6,213,780 B1 4/2001 Ho et al.
6,244,353 B1 6/2001 Greer
6,259,890 B1 7/2001 Driscoll et al.
6,266,659 B1 7/2001 Nadkarni
6,289,340 B1 9/2001 Puram et al.
6,311,164 B1 10/2001 Ogden
RE37,493 E 1/2002 Thomas
6,338,624 B1 1/2002 Kim
6,338,628 B1 1/2002 Smith
6,340,058 B1 1/2002 Dominick et al.
6,341,267 B1 1/2002 Taub
6,360,825 B1 3/2002 Padgett et al.
6,370,510 B1 4/2002 McGovern et al.
6,385,620 B1 5/2002 Kurzius et al.
6,442,370 B1 8/2002 Driscoll et al.
6,466,914 B2 10/2002 Mitsuoka et al.
6,484,010 B1 11/2002 Sheehan
6,493,723 B1 12/2002 Busche
6,513,042 B1 1/2003 Anderson et al.
6,514,079 B1 2/2003 McMenimen et al.
6,514,084 B1 2/2003 Thomas
6,524,109 B1 2/2003 Lacy et al.
6,567,784 B2 5/2003 Bukow
6,585,054 B1 7/2003 Thomas et al.
6,611,822 B1 8/2003 Beams et al.
6,618,734 B1 9/2003 Williams et al.
6,640,216 B1 10/2003 Loofbourrow et al.
6,648,077 B2 11/2003 Hoffman
6,681,098 B2 1/2004 Pfenninger et al.
6,691,122 B1 2/2004 Witte et al.
6,735,570 B1 5/2004 Lacy et al.
6,769,066 B1 7/2004 Botros et al.
6,796,382 B2 9/2004 Kaimart
6,873,964 B1 3/2005 Williams et al.
6,952,169 B1 10/2005 Simtion
RE39,081 E 5/2006 Thomas
7,036,603 B2 5/2006 Thomas et al.
7,100,701 B2 9/2006 Sprakel et al.
7,147,061 B2 12/2006 Tsutaoka et al.
2001/0011280 A1 8/2001 Gilbert et al.
2001/0031457 A1 10/2001 Pfenninger et al.
2001/0042000 A1 11/2001 Defoor et al.
2002/0019940 A1 2/2002 Matteson et al.
2002/0042786 A1 4/2002 Scarborough et al.
2002/0055866 A1 5/2002 Dewar
2002/0128892 A1 9/2002 Farenden
2002/0128893 A1 9/2002 Farenden
2002/0128894 A1 9/2002 Farenden
2002/0198766 A1 12/2002 Magrino et al.
2003/0037032 A1 2/2003 Neece et al.
2003/0101091 A1 5/2003 Levin et al.
2003/0191680 A1 10/2003 Dewar
2003/0195786 A1 10/2003 Dewar
2003/0200136 A1 10/2003 Dewar
2003/0222551 A1 12/2003 Toussaint
2004/0182584 A1 9/2004 Thompson
2004/0187957 A1 9/2004 Scheeter, Jr. et al.
2004/0194974 A1 10/2004 Arnot
2004/0237178 A1 12/2004 Landeros
2004/0237761 A1 12/2004 Gabriel
2004/0257726 A1 12/2004 Edstrom et al.
2004/0261953 A1 12/2004 Hart
2004/0262018 A1 12/2004 Roussin
2005/0011742 A1 1/2005 Yamamoto
2005/0039930 A1 2/2005 Gwak
2005/0047134 A1 3/2005 Mueller et al.
2005/0069207 A1 3/2005 Zakrzewski et al.
2005/0080636 A1 4/2005 Markwitz et al.
2005/0111995 A1 5/2005 Everson
2005/0115752 A1 6/2005 Ronacher et al.
2005/0124234 A1 6/2005 Sells et al.
2005/0126235 A1 6/2005 Melchiori
2005/0128751 A1 6/2005 Roberge et al.
2005/0131105 A1 6/2005 Choate et al.
2005/0139363 A1 6/2005 Thomas
2005/0148828 A1 7/2005 Lindsay
2005/0174473 A1 8/2005 Morgan et al.
2005/0178566 A1 8/2005 Meserve et al.
2005/0183867 A1 8/2005 Gaskill
2005/0199447 A1 9/2005 Benoist
2005/0274094 A1 12/2005 DeMarco
2005/0276053 A1 12/2005 Nortrup et al.
2006/0002110 A1 1/2006 Dowling et al.
2006/0002123 A1 1/2006 Hutzel et al.
2006/0022214 A1 2/2006 Morgan et al.
2006/0032641 A1 2/2006 Akins et al.
2006/0032642 A1 2/2006 Jacobson et al.
2006/0051224 A1 3/2006 Alsubiei
2006/0076820 A1 4/2006 Lacklore

(56) References Cited

U.S. PATENT DOCUMENTS

| | | | |
|---|---|---|---|
| 2006/0081060 | A1 | 4/2006 | Forster |
| 2006/0086876 | A1 | 4/2006 | Heerdt et al. |
| 2006/0097508 | A1 | 5/2006 | Bachman et al. |
| 2006/0131035 | A1 | 6/2006 | French |
| 2006/0141090 | A1 | 6/2006 | Lahouati |
| 2006/0162940 | A1 | 7/2006 | Pohler |
| 2006/0171779 | A1 | 8/2006 | Webb |
| 2006/0175067 | A1 | 8/2006 | Cover et al. |
| 2006/0188327 | A1 | 8/2006 | Moon |
| 2006/0201687 | A1 | 9/2006 | Fortenberry |
| 2006/0207773 | A1 | 9/2006 | Peltz |
| 2006/0217881 | A1 | 9/2006 | Pei et al. |
| 2006/0244277 | A1 | 11/2006 | Teran |
| 2006/0254783 | A1 | 11/2006 | Tsutaoka et al. |
| 2006/0269465 | A1 | 11/2006 | Mitani et al. |
| 2006/0278216 | A1 | 12/2006 | Gagas et al. |
| 2006/0293786 | A1 | 12/2006 | Baba et al. |

FOREIGN PATENT DOCUMENTS

| | | | |
|---|---|---|---|
| JP | 11-347142 | | 12/1999 |
| JP | 2001-204839 | | 7/2001 |
| JP | 2002-336369 | | 11/2002 |
| JP | 2004-298274 | | 10/2004 |
| JP | 2005-6833 | | 1/2005 |
| KR | 10-2005-0032924 | A | 4/2005 |
| WO | WO 9917242 | | 4/1999 |
| WO | WO 2006049212 | A1 | 11/2006 |

OTHER PUBLICATIONS

International Search Rpt, Jun. 25, 2008, Michael J. Nusbaum.

* cited by examiner

SELF-CONTAINED AUTOMATIC FIRE EXTINGUISHER

CLAIM OF PRIORITY

This application claims the benefit of priority of U.S. provisional application No. 60/901,948 filed Feb. 16, 2007, which is incorporated herein by reference.

FIELD OF THE INVENTION

The present invention relates to fire extinguishers, and more particularly relates to an automatically operated fire extinguisher for use within a residential or commercial dwelling.

BACKGROUND

The use of automatically activated fire extinguishing devices for commercial purposes is known. Such devices typically disperse fire extinguishing compound into a space, room or area. These devices are typically connected to pipes containing water under pressure. The prior art devices, however, are relatively bulky, unsightly and expensive to retrofit into existing homes. Some prior art automatic fire extinguishing devices store the fire extinguishing compound in a container which is either at a location remote from where the agent is dispersed or within an unsightly compartment which protrudes into the living or working space.

The prior art automatic fire extinguishing devices have the disadvantage of requiring a significant amount of time for installation, and significant expense over and above that typically required to install the in-wall/in-ceiling unit. This is due to the elaborate piping required to transport the fire extinguishing compound from the storage container to the spraying device. Moreover, the prior art automatic fire extinguishing devices also have the drawback that as the distance between the storage container and the spraying device (e.g. nozzles) is increased, a greater force is required to project the fire extinguishing compound. The in-wall/in-ceiling automatic fire extinguishing unit of the present invention can house one or multiple containers in series behind the drywall of a wall or ceiling with only an oval opening covered by an aesthetically pleasing decorative face plate of any shape or size.

The prior art storage container is limited by the unsightly appearance of the storage container and, the spray device (i.e., nozzle) typically extends into the room. The spray device and container generally detract from the overall appearance and is thus a deterrent to installation from an aesthetic perspective.

The prior art automatic fire extinguishing device has the further drawback that it must also have an unsightly fire sensing mechanism, which must protrude into the space, to determine the existence of a fire. The fire sensing mechanism, like the spray device and the self-contained box, is readily visible and detracts from the home's appearance.

There is thus a need for a fire extinguishing device which is unobtrusive, aesthetically and architecturally pleasing in appearance, relatively lightweight and streamlined, easy to self-install, self-contained, and does not require a substantial amount of time and money to install yet provides maximal protection to a home's occupants, heretofore unavailable to existing home owners.

None of the prior art, taken either singly or in combination, is seen to describe the invention as claimed.

SUMMARY OF THE INVENTION

The present invention is an article of manufacture comprising a self contained automatic fire extinguishing device having an expandable mounting bracket. In addition, the invention may further comprise a self contained automatic fire extinguishing device having at least two or more tanks containing a fire extinguishing agent, wherein said tanks are connected by at least one flexible pressurized joint. Also, the present invention teaches a self contained automatic fire extinguishing device capable of being installed in a wall or ceiling cavity, wherein said fire extinguishing device has an expandable mounting bracket which moves from a closed to an open position after the fire extinguishing device is inserted into said cavity. Finally, the invention teaches a method of installing a self contained automatic fire extinguishing device, comprising creating a hole in a wall or ceiling, inserting said self contained automatic fire extinguishing device into said hole, the self contained automatic fire extinguishing device having at least two or more tanks containing a fire extinguishing agent, wherein said tanks are connected by at least one flexible pressurized joint; and covering said hole with a decorative discharge plate.

It is accordingly an object of the present invention to provide an automatic fire extinguishing device for an existing home or other dwelling which is aesthetically pleasing, compact, self-contained and easy to install.

It is another object of the present invention to provide an automatic fire extinguishing device in which the fire extinguisher container, actuating mechanism and nozzle present no visible or obtrusive appearance other than that of a decorative face plate within a room or space.

It is an object of the present invention to teach an automatic fire extinguishing device where the sensor assembly and nozzle assembly are substantially flush with the plane of the wall or ceiling.

It is yet another object of the present invention to provide an automatic fire extinguishing device which does not require an extensive amount of time and expense for installation.

It is a further object of the present invention to provide an automatic fire extinguishing device which overcomes inherent disadvantages of known automatic fire extinguishing devices.

It is also an object of the invention to teach a fire extinguishing device having a sprinkler head attached thereto.

It is an additional object of the invention to provide a self contained automatic fire extinguishing device suitable for use in any dwelling, residential or commercial, in houses, apartments, condominiums, and all types of commercial properties, of any size or of any number of rooms.

It is a further object of the present invention to provide a self-contained automatic fire extinguishing device that is located within a wall or ceiling and housed within the space between two studs or joists.

It is a further object of the present invention to provide a unit which includes a container or series of containers attached via flexible pressurized joints, and held in place by an expanding bracket.

It is a further object of the present invention to provide a fire extinguisher which maintains a constantly high pressure inside a shell of the fire extinguisher through out a shelf-life of the fire extinguisher and which can indicate the charge status of the tank via a visible indicator.

It is a further object of the present invention to provide a unit which is attached to a sensor which reacts to prolonged exposure to direct heat and which can extend beyond the wall or ceiling into the living space when actuated.

It is a further object of the present invention to provide a self-contained automatic fire extinguishing device which is hidden behind a decorative face plate which permits the passage of the sensing device and a tank fill status indicator and which actuates out of the path of the sprinkler head upon activation.

It is a further object of the present invention to provide a self-contained automatic fire extinguishing device which, prior to activation, emits an audible warning sound from the device to indicate the presence of a fire and an impending activation.

It is a further object of the present invention to provide a self-contained automatic fire extinguishing device which, once activated, can disperse fire extinguisher contents into a living space and thus significantly retarding or completely extinguishing a fire.

It is also an object of the present invention to teach a method of networking the self contained, automatic fire extinguishers of the present invention together so that if one is actuated in a dwelling, then one or more other extinguishers are actuated.

It is a further object of the present invention to provide a self-contained automatic fire extinguishing device which, is activated by a heat sensitive actuator connected to a control box. The control box receives and processes the heat signal, emits a warning sound (of user adjustable time period and volume) and then causes the fire extinguisher to disperse its contents into a living space and thus significantly retarding or completely extinguishing a fire.

DESCRIPTION OF THE PREFERRED EMBODIMENT

Figure 1:
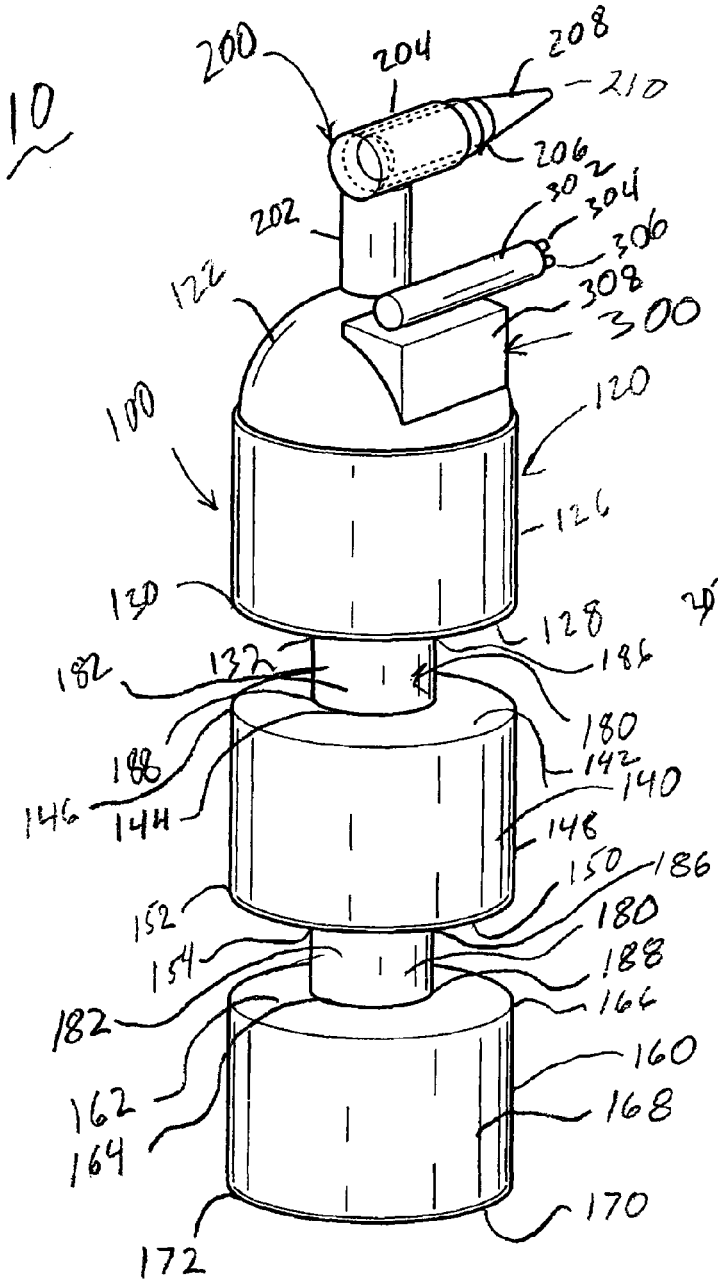
FIG. 1 is a perspective view of a self contained automatic sprinkling device, showing the tank assembly having a primary tank, and intermediate tank, and a lower tank, connected by flexible pressurized joints. Also seen is the nozzle assembly and sensor assembly.
Figure 2:
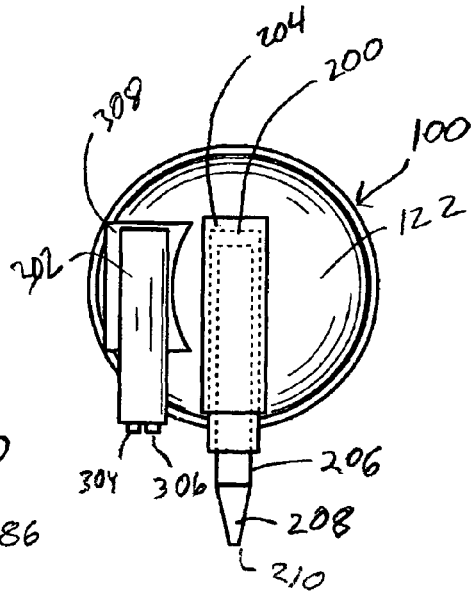
FIG. 2 is a top view of a preferred embodiment of the invention, showing the primary tank and the nozzle assembly and the sensor assembly.
Figure 3:
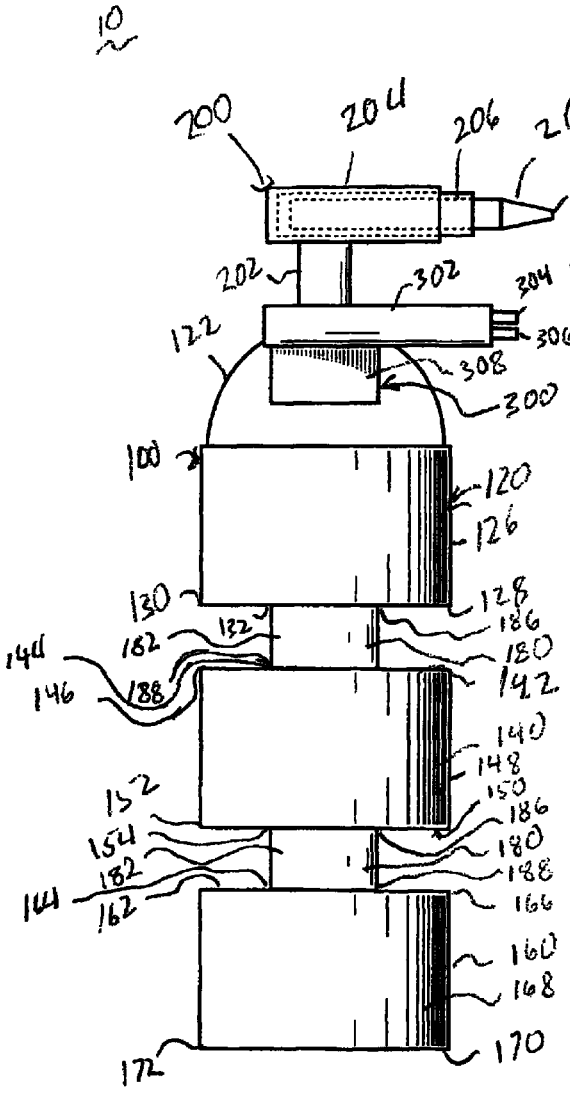
FIG. 3 is a left side view of a preferred embodiment of the invention showing the tank assembly having a primary tank, and intermediate tank, and a lower tank, connected by flexible pressurized joints. Also seen is the nozzle assembly and sensor assembly.
Figure 4:
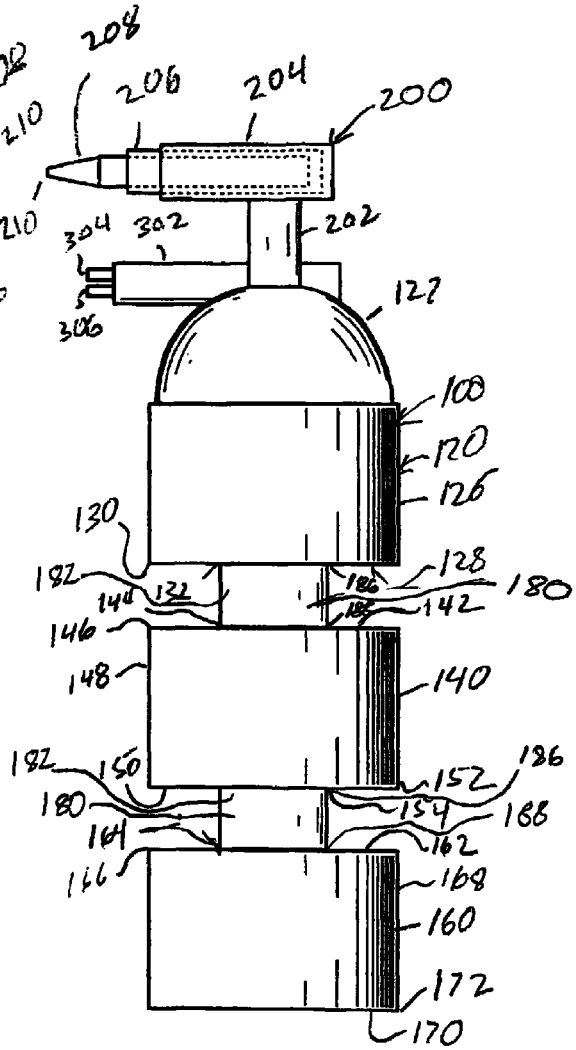
FIG. 4 is a right side view of a preferred embodiment of the invention showing the tank assembly having a primary tank, and intermediate tank, and a lower tank, connected by flexible pressurized joints. Also seen is the nozzle assembly and sensor assembly.
Figure 5:
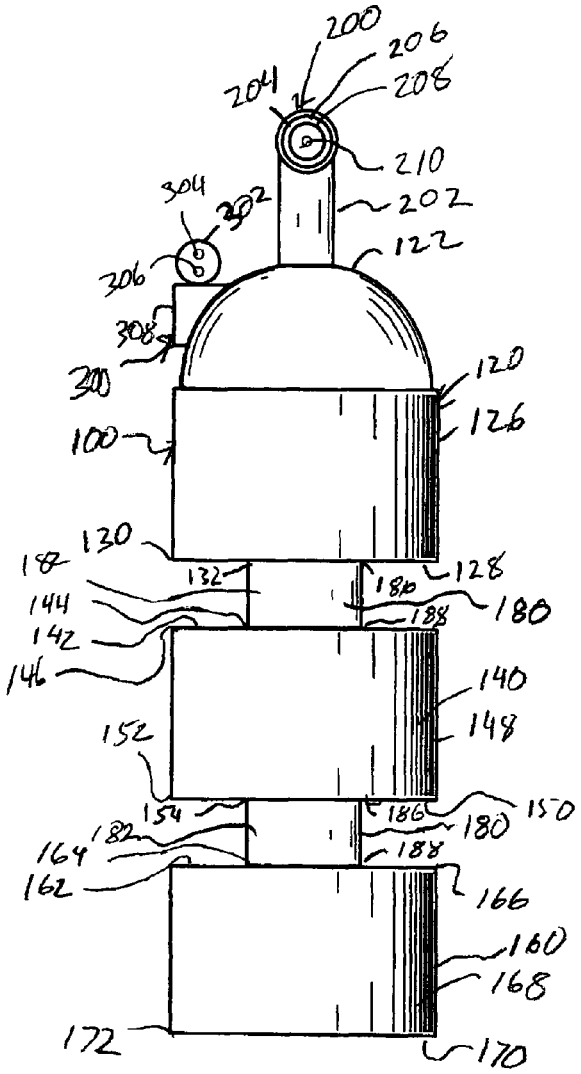
FIG. 5 is a front view of a preferred embodiment of the invention showing the tank assembly having a primary tank, and intermediate tank, and a lower tank, connected by flexible pressurized joints. Also seen is the nozzle assembly and sensor assembly.
Figure 6:
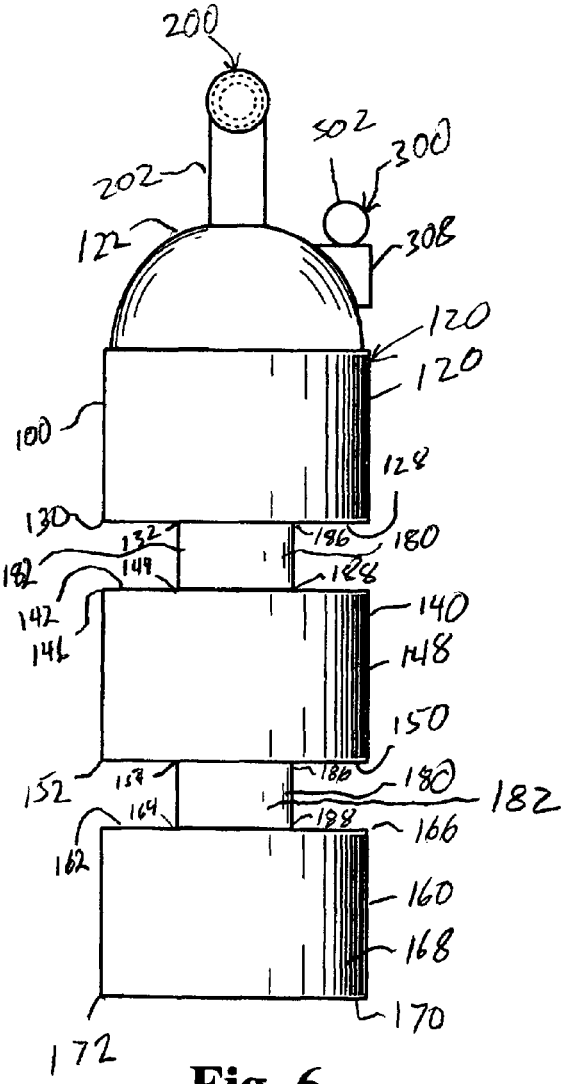
FIG. 6 is a rear view of a preferred embodiment of the invention showing the tank assembly having a primary tank, and intermediate tank, and a lower tank, connected by flexible pressurized joints. Also seen is the nozzle assembly and sensor assembly.

The preferred embodiments of the present invention will now be described with reference to FIG. 1-13 of the drawings. Identical elements in the various figures are identified with the same reference numerals.

The invention is a self contained automatic fire extinguisher that can be placed in a wall or ceiling cavity. By "self contained" it is meant that the components necessary to detect and extinguish or retard a fire are fashioned into a single unit. For example, while the unit may have some components which are powered by battery power, it is not expected that the unit will require external power sources. Also, the unit will operate without external connections to piping, etc. for extinguishing agent or pressure. By "automatic" it is meant the extinguishing device can react to a fire without human intervention.

Referring now to the figures, FIG. 1-5 show the automatic fire extinguisher 10 of the present invention in perspective, top, left and right side views, and front and rear views respectively. Automatic fire extinguisher 10 has tank assembly 100, nozzle assembly 200 and sensor assembly 300.

Primary tank 120 has dome 122, optional divider 124 (not shown), wall 126, bottom 128, bottom edge 130, and bottom opening 132. Optional intermediate tank or tanks 140, have top 142, top opening 144, top edge 146, wall 148, bottom 150, bottom edge 152, and bottom opening 154. Optional lower tank 160, has top 162, top opening 164, top edge 166, wall 168, bottom 170, and bottom edge 172.

The fire extinguisher of the present invention can comprise just a primary tank 120, or, in other embodiments, may include one or more intermediate tanks 140 and or lower tank 160. The tanks are preferably constructed of metal, such as aluminum, stainless steel or steel, depending on the type of extinguishing agent used, and the walls are of sufficient thickness to maintain the tank's integrity under pressure. Other materials such as fire resistant plastics or rubber optionally reinforced with cloth or fiber may be used in construction of the tank if they are of sufficient strength and thickness to maintain the tank's integrity under pressure, and if they can withstand the high heat levels associated with a fire. While it is expected that the tanks will preferably consist of single hollow vessels, it is possible that in other embodiments the tank could have multiple chambers. For example, some fire extinguishing systems rely on liquefied or pressurized gas, and in those cases an additional chamber or cartridge may be necessary. Also, differing extinguishing agents or agents requiring two components, such as in some dry extinguisher systems, must be stored separately and therefore may require separate chambers.

The tanks should be sized to fit within the space defined by a wall or ceiling. A "wall cavity" or "ceiling cavity" contains one or more substantially parallel surfaces and is the area defined by the wall studs or ceiling joists and the inside surface of the front and back wall covering. The front and back wall covering can be made of typical construction materials such as, but not limited to, plaster, wallboard, ceiling joists, wall studs, plywood and combinations thereof. The studs, joists, etc. can be constructed of typical building materials such as wood, stone, brick, metal, plywood, engineered materials, etc.

Thus, in a preferred embodiment, the diameter of the tanks would be between 1 and 6 inches, the larger sizes being meant to accommodate deeper walls or ceiling installations, the smaller diameters being preferred for standard wall cavities of about 3.5". The primary tank will have a height of between 2" and 12" while the intermediate tanks and lower tanks will have a height of between 1" and 12". The tank(s) will be of sufficient capacity to cover an entire room, yet fit through a small opening in a wall or ceiling.

The number of tanks can be varied depending on the type of fire extinguishing agent used, the area or size of room to be protected, and the number of fire extinguishing devices that will be installed in a given room. The fire extinguisher of the present invention could be made as a single pre-manufactured unit without variation in the size or number of tanks, or made on a custom basis with each unit individually configured depending on the floor plan of a particular house, or each fire extinguisher being custom configured with the appropriate number of tanks based on the size of the room to be covered.

Primary tank 120 has dome portion 122 connected to tank wall 126. Dome portion 122 serves as a support for nozzle assembly 200 and sensor assembly 300. Dome portion 122 can simply be an extension of wall 126, wherein it would contain fire extinguishing agent 450 or if primary tank has divider 124 (not shown) then the area under dome portion 122 can house electrical or mechanical components of the invention, such as components for sensor 306, status indicator 304, audible alarm or networking device.

Depending on the type of extinguishing agent used, primary tank 120 may also hold a cartridge filled with liquid carbon dioxide, or other pressurized or liquefied gas or non-toxic extinguishing agent. If this is the case, then there may also be a siphon tube 354 which runs from the nozzle 208 to the bottom of the primary tank 120 or the lower tank 160. See FIG. 10. When the sensor senses a fire, the actuator opens the gas cartridge, the gas evaporates and creates pressure, forcing the fire extinguishing agent out of the siphon tube and through the nozzle into the burning room.

While the drawings show the primary shape of the tanks as cylindrical, other tank shapes are possible. For example, the automatic fire extinguisher of the present invention could have a bottom tank with an oblate rounded edge (i.e. inverted dome) that will facilitate placement within a wall or ceiling cavity. Tanks with rounded top or dome shaped edges could facilitate the removal of the device from the wall for maintenance or recharging. Other embodiments are possible, such as spheroids (either prolate or oblate), spherical or rectangular shaped tanks.

The tanks are connected by flexible pressurized joints 180, having flexible tube 182, internal diameter 184, first connection 186 and second connection 188.

The flexible pressurized joint 180 connects two tanks. It can be any type of joint that allows the two tanks to move in spatial relation to each other, in order to further the objects of the invention. For example, the flexible pressurized joint could be hinged joint, or other flexible joint. The flexible pressurized joint is preferably a flexible tube created from rubber, vinyl, plastic, flexible steel, flexible steel braid, or any other flexible material that can be pressurized and can withstand the weight of one or more intermediate or bottom tanks. The material selected should be non-reactive with fire extinguishing agent and withstand temperatures consistent with industry standards as well as federal and local regulations and in the case of rubber, vinyl or plastic may be reinforced with fiberglass, fiber, cloth or other material. Composites and combinations of the aforementioned materials may also be used, such as flexible steel having a liner of rubber, vinyl or plastic.

The internal diameter 184 of the flexible pressurized joint 180 should be sufficient size to allow rapid passage of the fire extinguishing agent from one tank to another during charging or discharge. The flexible tube 182 should be of a length sufficient to allow the fire extinguisher to flex in the manner illustrated in FIG. 9 during installation.

The flexible pressurized joint has first connection 186 and second connection 188 that allow the end of the flexible pressurized joint to sealably connect with the tank. The joint should be sufficiently sealed so the system remains free of leaks over long periods of time, preferably at least several years. The connections can be male and female threaded connectors, interlocking grommets that create a seal when mated, crimp type joints, flanged connectors, or integrated components during manufacturing. For example, bottom opening 132, 154 and/or top opening 144 and 164 could be tapped with female threads and flexible tube 182 could have matching threaded male connectors. See FIG. 10.

The automatic fire extinguisher of the present invention also has nozzle assembly 200, nozzle support 202, nozzle casing 204, nozzle extension 206, nozzle 208 and aperture 210. Nozzle support 202 is preferably metal, such as steel, stainless steel or aluminum but could be constructed from plastic or rubber. It can be of any configuration necessary to support the nozzle casing 204. It is of sufficient diameter to allow fire extinguishing agent to discharge rapidly from the primary tank 120 and into nozzle 208. It may be desirable in some embodiments to rotatably connect nozzle support 202 to primary tank 120 so that nozzle 208 can rotate laterally, at least during initial installation, in order to provide some adjustability to where the nozzle 208 points during discharge of the fire extinguishing agent.

Nozzle casing 204 is preferably metal, such as steel, stainless steel or aluminum but could be constructed from fire resistant plastic or rubber. It can be of any configuration necessary to support the nozzle extension 206. It may be desirable in some embodiments to rotatably connect nozzle casing 204 to nozzle support 202 so that nozzle 208 can rotate laterally or longitudinally, at least during initial installation, in order to provide some adjustability to where the nozzle 208 points during discharge of the fire extinguishing agent.

Figure 14:
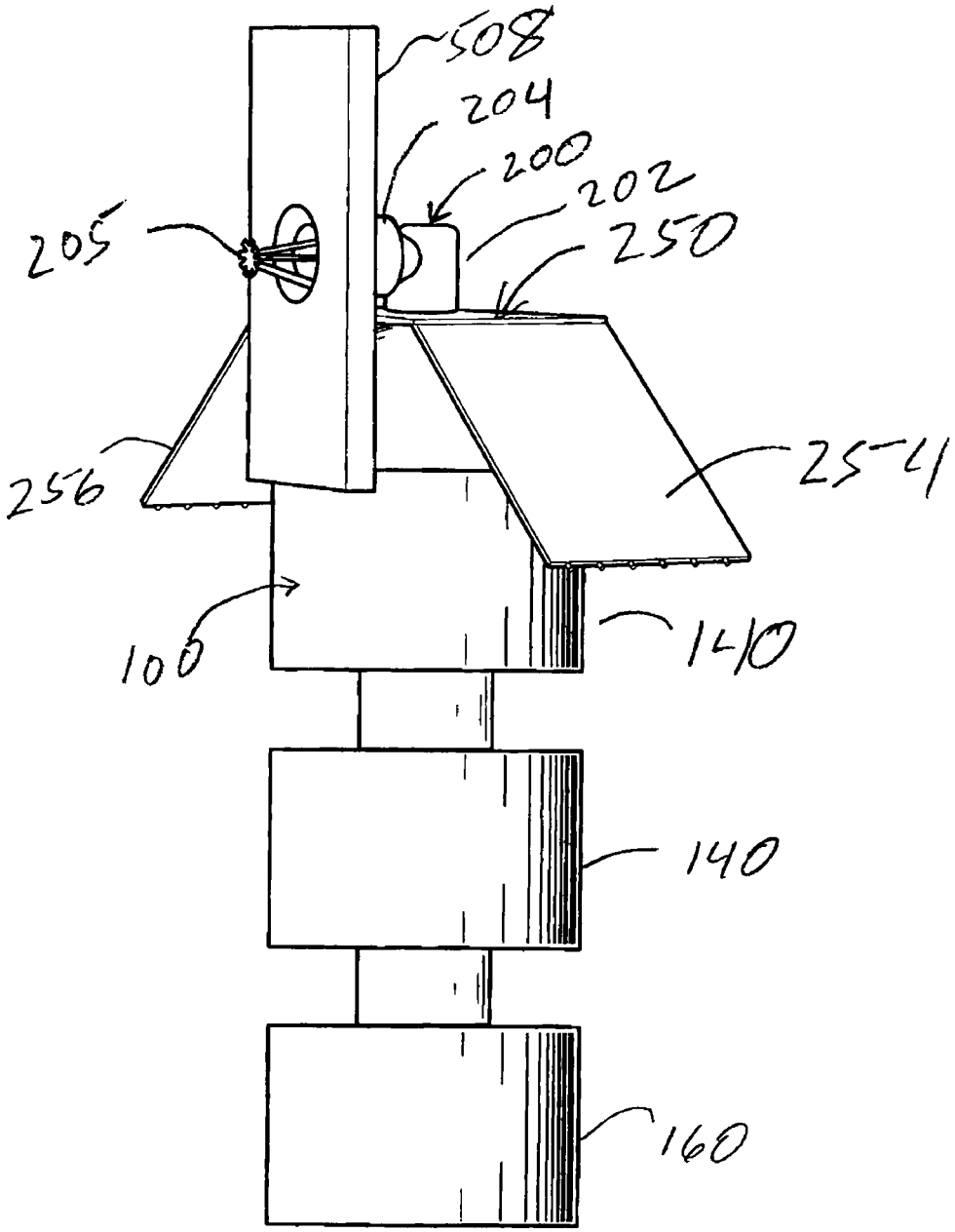
FIG. 14 is a perspective view of another preferred embodiment showing a conventional sprinkler head attached to the nozzle casing.

In preferred embodiments, nozzle extension 206 allows nozzle to protrude into a room during a fire. During a fire, nozzle extension 206 and nozzle 208 extend past the plane of the wall or ceiling, and nozzle extension 206 can be any mechanical method that allows the movement of nozzle 208 from behind wall 508 past wall 508 and into a room. In one preferred embodiment, nozzle 208 can also be a traditional fire sprinkler head. Nozzle extension 206 is preferably a telescoping mechanism made from successively smaller diameter sections of tubing as seen in FIG. 1. Once the discharge of the extinguishing agent begins, pressure forces nozzle 208 forward. Other extension assemblies are possible, such a wound plastic coil or bent tube that expands into a straight tube when filled with fire extinguishing agent under pressure. In the alternative, nozzle extension 206 could be stationary, and nozzle 208 could be designed to spray the fire extinguishing agent into the room. In another preferred embodiment nozzle 208 is a traditional fire sprinkler head, as seen in FIG. 14. Thus, a sprinkler head could be attached to the nozzle extension 206 and extend into the room as discussed, or it could be stationary and disposed directly on nozzle extension 206 and/or nozzle casing 204 and/or nozzle support 202.

Nozzle 208 has an aperture 210 designed to spray the fire extinguishing agent in an appropriate pattern. For example, with devices that are to be installed in a wall close to a ceiling, it may be desirable to have a dispersement pattern where the extinguishing agent is directed outwards and downwards. For devices that are installed in a wall at roughly midpoint between the ceiling and floor, a desirable dispersement pattern may be upwards, downwards and outwards. Units installed in the center of the ceiling may have radial patterns, whereas units installed in the corner of a ceiling may radiate in a 90 degree pattern. The aperture 210 may be adjustable to different dispersion patterns or nozzle 208 may be fitted with different apertures able to create different dispersion patterns or an installer adjustable nozzle to create a custom dispersion pattern based on room size and shape.

Also shown are optional mounting assembly 250, lateral bracket 252, first expanding arm 254 and second expanding arm 256.

Turning now to optional sensor assembly 300, it has sensor housing 302, status indicator 304, sensor 306 and sensor mount 308. Sensor housing 302 is constructed of metal or heat resistant plastic or rubber. Sensor housing 302 contains status indicator 304 and sensor 306. The actual size and shape of sensor housing 302 is variable, depending on the components contained therein.

Sensor 306 is a heat responsive actuating element capable of triggering or activating discharge of the fire extinguishing agent. In a preferred embodiment it is similar to an automatic sprinkler head. In this case it can have of a fusible metal component which melts when exposed to high temperatures. Melting of the metal component causes a mechanical actuator to open a valve, in turn triggering release of the fire extinguishing agent. In one embodiment a liquefied gas expands into the tank assembly 120, creating pressure which forces the fire extinguishing agent out of the siphon tube 192 and through the nozzle 208 and onto the fire. Fusible metal sensors are well known in the art and have been used for activating sprinkler systems and can be employed in this device. In addition, the sensor 306 may be either an infrared photodetector or a pyroelectric ceramic sensor, or any other type of sensor which generates electrical signals corresponding to the radiated energy sensed by the sensor. The sensor 306 can detect a fire in the room, which then generates electrical signals which can actuate mechanical valves which release the fire extinguishing agent 450.

Status indicator 304 can be any device that monitors the pressure inside tank assembly 100, and indicates if the tank pressure is too low or needs to be recharged. For example, it can consist of a single low voltage electrical light that turns red when the pressure within the tank drops below the appropriate level, or it can switch from green to red. Alternatively, the status indicator can be a mechanical gauge or audible warning that indicates when the pressure is too low and the unit needs to be recharged or replaced.

A variety of fire extinguishing agents 450 may be used for flame suppression, which use either chemical or physical action, or both. One conventional agent is a pressurized water extinguisher that eliminates fire by thermal energy absorption. Carbon dioxide and dry-chemical extinguishers are another type of fire extinguishing agent and work by displacing oxygen and absorbing thermal energy. Other agents include sodium bicarbonate extinguishers, as well as potassium bicarbonate, urea-based potassium bicarbonate, and potassium chloride extinguishers. Yet another conventional fire extinguisher is the foam (AFFF or FFFP) model, which coats flammable liquids with a chemical to lower the temperature or eliminate oxygen supply. Any of the agents described above, or any other fire extinguishing agent, is a suitable fire extinguishing agent for purposes of the invention. One particularly preferred agent is FE 36, manufactured by DuPont (Wilmington, Del.).

Figure 7:
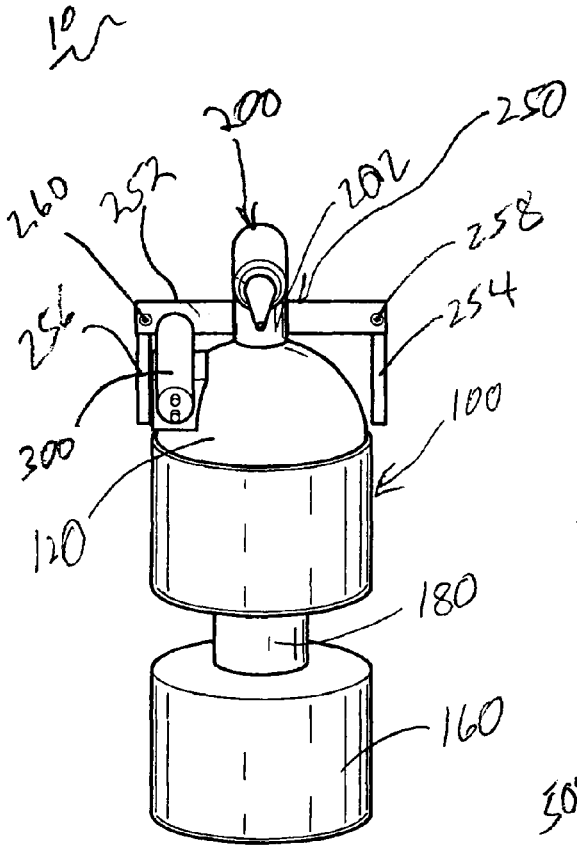
FIG. 7 is a perspective view of a preferred embodiment of the invention, showing an embodiment only having a primary tank and a lower tank. Also shown is the expandable mounting bracket, as well as the nozzle assembly and the sensor assembly.

FIG. 7 shows an embodiment of the invention having tank assembly 100 with only primary tank 120 and lower tank 160, with a single flexible pressurized joint 180. FIG. 7 also shows nozzle assembly 200, sensor assembly 300, and mounting assembly 250 attached to nozzle support 202. The mounting assembly 250 of the present invention can be any type of mount suitable maintaining the invention in a fixed position in a wall or ceiling. For example, an appropriate mounting assembly may constitute brackets or hood that can be screwed, nailed, bolted or otherwise fastened to joists or to the wall or ceiling itself. In a preferred embodiment, mounting assembly 250 is an expandable mounting bracket. As seen in FIG. 7, the expandable mounting bracket has lateral bracket 252, first expanding arm 254 and second expanding arm 256. The expandable bracket is most likely to be mounted on nozzle support 202, but could be mounted anywhere and in any manner on primary tank 120 so long as it is configured in a manner consistent with the principles described herein. Expanding arms 254 and 256 are plates that will run parallel to the wall studs and extend out into the wall studs to lock the unit in place and prevent "pitch" of the unit along its longitudinal axis. In addition, the joint for expanding arms 254 and 256 is preferably in line with the lateral most aspect of the tanks. In the retracted position, expanding arms 254 and 256 will be in contact with the sides of primary tank 120. The expandable mounting bracket, should be sized so that when collapsed, is short enough to negotiate the opening and the space between the dry wall. A Philips head screw or other fastener is located at these joints 258 and 260 to rotate and lock the arms into place when tightened, moving them from the closed to the open position. This bracket may be either the extendable arm as described or a scissoring "X" bracket that extends out from a flat "X" to brace against the studs. Other types of expandable mounting brackets are possible, for example those that would mount to the rear wall, ceiling joists, wall studs, etc. with or without expanding arms, such as those with swinging or twisting parts, and such designs would be within the scope of the present invention.

Figure 8:
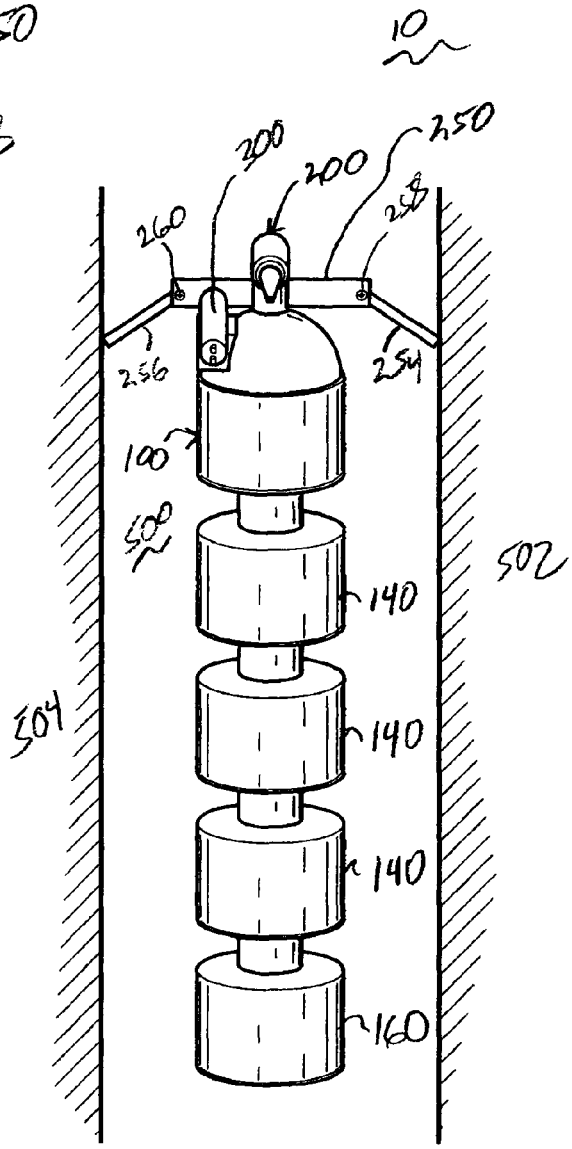
FIG. 8 is a perspective view of a preferred embodiment of the invention, showing the invention installed between two parallel surfaces, with the mounting bracket expanded and multiple intermediate tanks.

FIG. 8. shows the invention with tank assembly 100, nozzle assembly 200, mounting assembly 250, and sensor assembly 300. Shown is a typical installation, namely automatic fire extinguisher 10 installed in wall cavity 500, with first expanding arm 254 and second expanding arm 256 expanded and creating opposing force against parallel surfaces 502 and 504, i.e., wall joists 502 and 504. FIG. 8 also shows automatic fire extinguisher 10 having multiple intermediate tanks 140 and lower tank 160.

Figure 9:
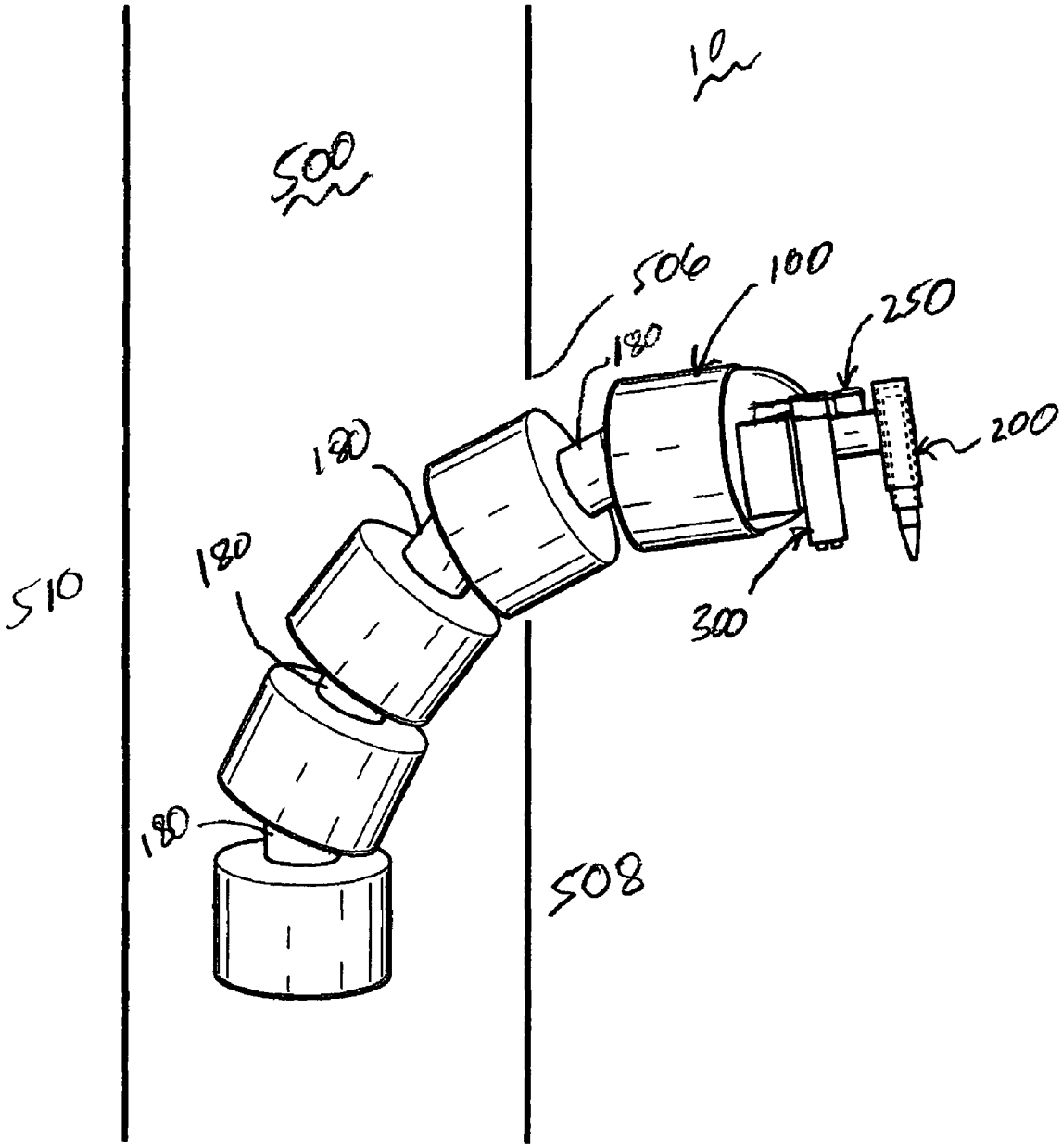
FIG. 9 is a side view of the invention, showing the invention being installed in a wall cavity. This figure shows how the flexible joints facilitate installation of the device.

FIG. 9 shows the installation of the invention into wall cavity 500 with tank assembly 100, nozzle assembly 200, mounting assembly 250, and sensor assembly 300. Wall opening 506 is created by the user in front wall 508, and then invention 10 is flexibly inserted through wall opening 506 and into wall cavity 500. The wall opening may then be covered by a decorative face plate, 400 (not shown). Wall opening 506 can be circular or oval or rectangularly shaped, or in any other shape or configuration. A similar method may be used if the invention is to be installed in a ceiling. The user may be supplied with a template that facilitates the cutting of the shape on the wall or ceiling. Flexible pressurized joints 180 permit the automatic fire extinguisher 10 to conform to space defined by the distance between front wall 508 and back wall 510, or in the ceiling cavity created by the ceiling and ceiling joists.

Figure 10:
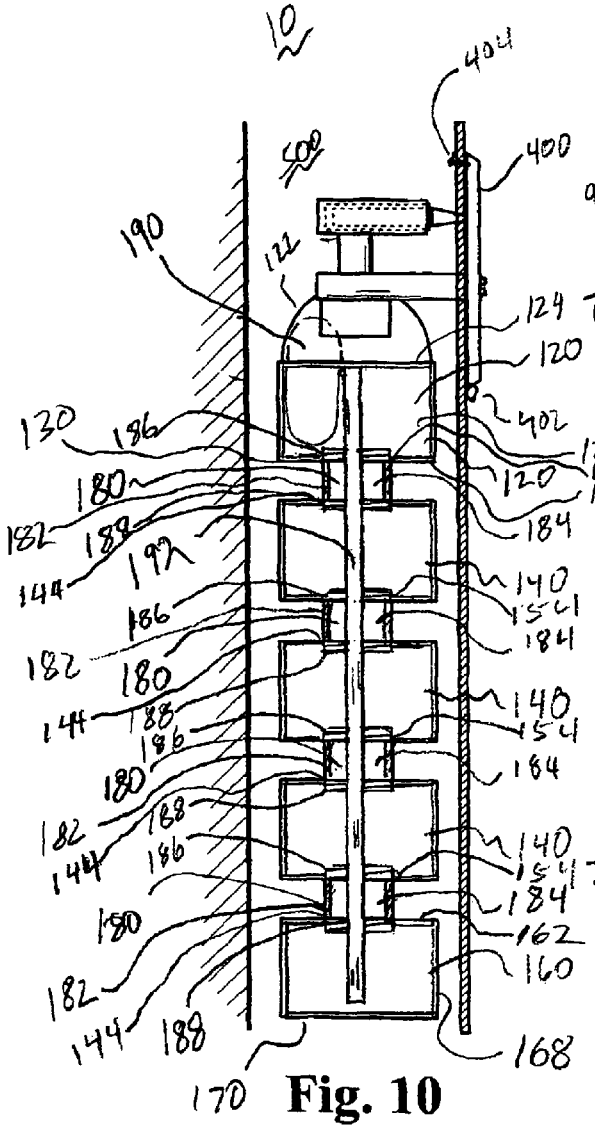
FIG. 10 is a partial cutaway view of the invention, showing the invention installed in a wall cavity. The drawing shows the decorative mounting plate with hinge and capture. It further shows the sensor and indicator protruding through the decorative plate.

FIG. 10 is a partial side cutaway view of automatic fire extinguisher 10 fully installed in wall cavity 500. Decorative plate 400 is installed with plate hinge 402 and plate capture 404. Primary tank 120, intermediate tanks 140 and lower tank 160 are seen, with flexible pressurized joints 180.

Primary tank 120 has dome 122, optional divider 124, wall 126, bottom 128, bottom edge 130, and bottom opening 132. Optional intermediate tank or tanks 140, have top opening 144 and bottom opening 154. Lower tank 160, has top 162, top opening 164, wall 168, and bottom 170.

The tanks in FIG. 10 are connected by flexible pressurized joints 180, having flexible tube 182, inside diameter 184, first connection 186 and second connection 188. Also shown is optional gas canister 190 and optional siphon tube 192. Optional siphon tube 192 is flexible so it can bend in the same manner as tank assembly 100 flexes during insertion as seen in FIG. 9.

Figure 11:
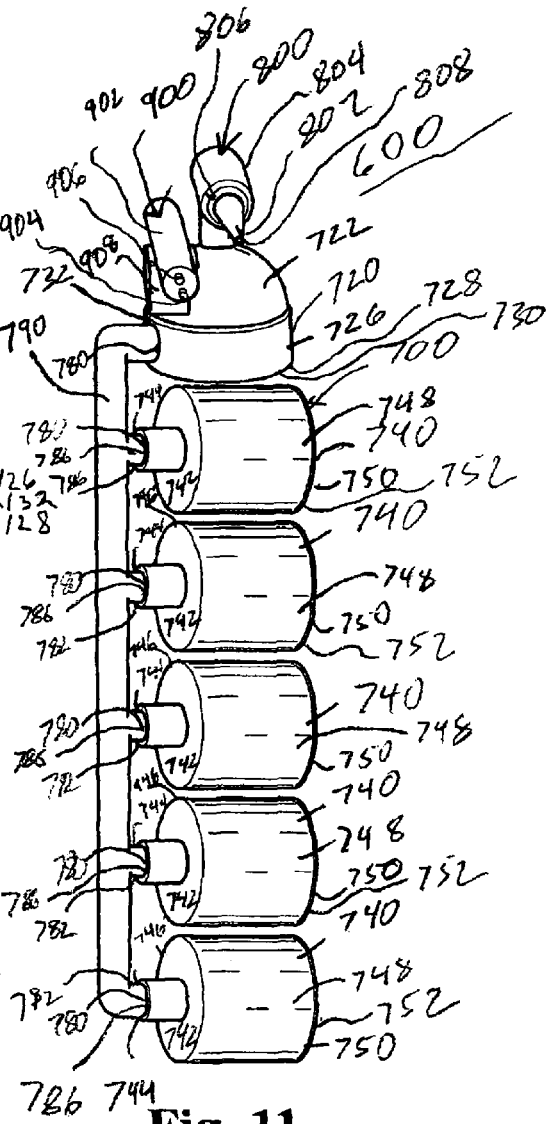
FIG. 11 is a perspective view of an alternate embodiment of the invention, where multiple tanks are connected to the primary tank by means of a flexible conduit.

FIG. 11 shows an alternate embodiment of the automatic fire extinguisher 600 of the present invention. Automatic fire extinguisher 600 has tank assembly 700, nozzle assembly 800 and sensor assembly 900.

Primary tank 720 has dome 722, wall 726, bottom 728, bottom edge 730, and side opening 732. Optional intermediate tank or tanks 740, have top 742, top opening 744, top edge 746, wall 748, bottom 750, and bottom edge 752.

The tanks in FIG. 11 are connected by flexible pressurized joints 780, each having flexible tube 782, connection 786. Flexible pressurized joints 780 connect into main conduit 790, which connects into primary tank 720. Main conduit 790 is flexible and allows the tank assembly 700 to flexibly orient into a wall or ceiling cavity.

The automatic fire extinguisher of the present invention also has nozzle assembly 800, nozzle support 802, nozzle casing 804, nozzle extension 806 and nozzle 808.

Sensor assembly 900, it has sensor housing 902, status indicator 904, sensor 906 and sensor mount 908. In addition alternate embodiment 600 also may have optional mounting assembly 950 (not shown) similar to mounting assembly 250.

Figure 12:
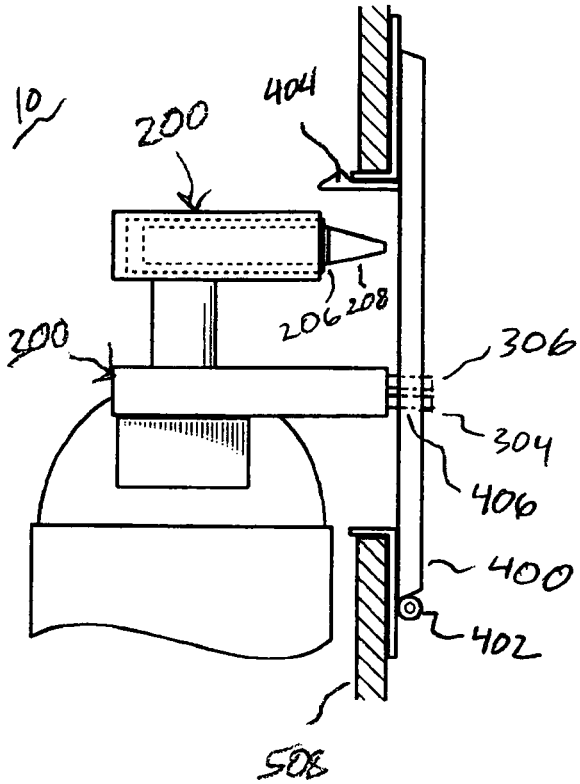
FIG. 12 is a partial side view of the invention in its ready position.
Figure 13:
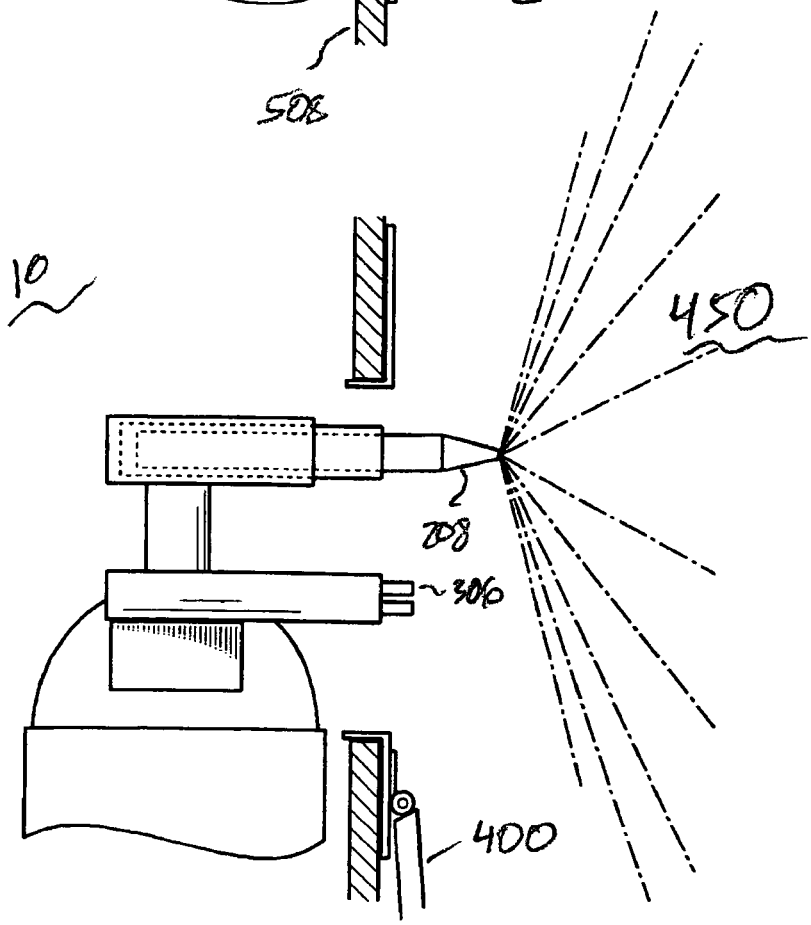
FIG. 13 is a partial side view of the invention in operation, where the nozzle has extended, the decorative plate opened and the fire extinguishing agent begun dispersing.

FIGS. 12 and 13 show self contained automatic fire extinguisher device 10 in operation. FIG. 12 shows the invention in the ready position. Nozzle extension 206 is in the fully retracted position. Sensor 306 and status indicator 304 protrude through decorative plate access 406. It is important to note that nozzle assembly 200 and status assembly 300 do not substantially extend past the plane of wall 508, and are therefore substantially flush with wall 508. Preferably, nozzle assembly 200 and status assembly 300 do not extend more than 1", and more preferably less than 0.5" past the plane of wall 508. Decorative plate 400 is movably suspended on hinge 402 and decorative plate capture 404 prevents decorative plate 400 from falling to the open position when the fire extinguisher is not discharging fire extinguishing agent 450. The decorative plate 400 can be made of any material, such as plastic, metal, paper, glass, or a building material such as wall board, plaster or plywood. In addition, there may be an insert plate 410 that fits into the rough opening and which will lock into place on the dry wall. The decorative plate 400 may be hinged off of insert plate 410. Insert plate 410 could have arms that help support the unit while the expandable mounting brackets are being extended during installation.

The decorative plate could also be part of or affixed to the nozzle 208, and/or not be a separate piece. FIG. 13 shows the fire extinguisher 10 of the present invention in use, where the sensor 306 has activated the actuating valve (not shown), releasing the fire extinguishing agent 450. The pressure exerted by the discharging agent 450 extends nozzle 208 forward, exerting force against decorative plate 400, disengaging the decorative plate capture and moving decorative plate 400 to the open position as seen in FIG. 13. Alternative methods of "moving" decorative plate 400 are possible, for example, the plate could melt away during a fire, or simply fall to the ground. It could also be moved by a mechanism that operates independently of the discharge tube activating.

FIG. 14 shows a highly preferred embodiment of the invention, with tank assembly 100, nozzle assembly 200, and mounting assembly 250. Mounting assembly 250 has first expanding arm 254 and second expanding arm 256 expanded, which can create an opposing force against parallel surfaces. FIG. 14 also shows automatic fire extinguisher 10 having multiple intermediate tanks 140 and lower tank 160. FIG. 14 shows that nozzle 208 is a traditional fire sprinkler head 205. Sprinkler head 205 could be any conventional sprinkler head used in fire protection systems and can be disposed on tank assembly 10 in any manner, and can be extending or stationary. Thus, a sprinkler head 205 could be attached to the nozzle extension 206 and extend into the room as discussed, or it could be stationary and disposed directly on nozzle extension 206 and/or nozzle casing 204 and/or nozzle support 202 in which case it would remain stationary relative to wall 508.

The present invention may also have an audible or visible warning system located in dome 122 or sensor housing 302. The audible alarm, preferably similar to those used in fire detectors, creates a loud signal after sensor 306 detects a fire. In addition it is possible that multiple devices could be networked together, so that if one extinguishing system is activated, then others in the same or adjoining rooms are activated. The activation of one unit by another can take place using audible sensors, which react to the alarm signal of the first, or are networked using a wireless connection or could be hard wired together.

In general, all of the components of the invention should be able to withstand temperatures consistent with industry standards as well as federal and local regulations.

Although this invention has been described with a certain degree of particularity, it is to be understood that the present disclosure has been made only by way of illustration and that numerous changes in the details of construction and arrangement of parts may be resorted to without departing from the spirit and the scope of the invention.

I claim:

1. An article of manufacture that is a self contained automatic fire extinguishing device, comprising:

a primary tank containing a fire extinguishing agent and a pressurized gas canister;

an extendable mounting bracket, having a lateral bracket, a first rigid arm and a second rigid arm, said lateral bracket being rigidly attached to said primary tank, and said rigid arms being rotatably attached said lateral bracket on opposite ends of said lateral bracket;

a lower tank, containing said fire extinguishing agent and having a cross-section substantially equal in shape and size to a cross-section of said primary tank, said lower tank being hangingly connected to, beneath, and in fluid connection with, said primary tank, by a flexible pressurized joint;

an extendable discharge nozzle, mounted on said primary tank and having an axis of flow orientated substantially horizontally when said self contained automatic fire extinguishing device is installed; and a flexible siphon tube, attached at one end to said extendable discharge nozzle, and extending down through said flexible pressurized joint to said lower tank.

2. The article of claim 1, further comprising at least one intermediate tank, containing said fire extinguishing agent and having a cross-section substantially equal in shape and size to a cross-section of said primary tank, said intermediate tank being hangingly connected to, beneath, and in fluid connection with, at least said primary tank or another intermediate tank, by a flexible pressurized joint; and wherein said lower tank is hangingly connected to, beneath, and in fluid connection with, said at least one intermediate tank, by a flexible pressurized joint.

3. The article of claim 1, wherein the fire extinguishing device has a sprinkler head disposed thereon.

4. The article of claim 1 wherein said automatic fire extinguishing device has a heat responsive actuating element capable of initiating discharge of the fire extinguishing agent.

5. The article of claim 1, wherein the automatic fire extinguishing device has a status indicator.

6. The article of claim 4, which creates an audible warning before actuating discharge of the fire extinguishing agent.

7. The article of claim 4, further comprising a discharge plate which moves when said fire extinguishing agent is discharged.

8. The article of claim 1, wherein said self contained fire extinguishing device may be actuated by another fire extinguishing device or monitor.

* * * * *